US006278787B1

(12) United States Patent
Azima

(10) Patent No.: US 6,278,787 B1
(45) Date of Patent: Aug. 21, 2001

(54) LOUDSPEAKERS

(75) Inventor: Henry Azima, Cambridge (GB)

(73) Assignee: New Transducers Limited, London (GB)

( * ) Notice: Subject to any disclaimer, the term of this patent is extended or adjusted under 35 U.S.C. 154(b) by 0 days.

(21) Appl. No.: 09/417,052

(22) Filed: Oct. 13, 1999

Related U.S. Application Data

(63) Continuation-in-part of application No. 08/707,012, filed on Sep. 3, 1996.
(60) Provisional application No. 60/150,804, filed on Aug. 26, 1999.

(30) Foreign Application Priority Data

Oct. 13, 1998 (GB) ..... 9822246

(51) Int. Cl.[7] ..... H04R 25/00
(52) U.S. Cl. ..... 381/152; 381/398; 381/425
(58) Field of Search ..... 381/152, 396, 381/353, 354, 423, 425, 431, 426, FOR 162, 398; 181/150

(56) References Cited

U.S. PATENT DOCUMENTS 3,247,925 4/1966 Warnaka ..... 181/31
4,392,027 * 7/1983 Bock ..... 381/152
4,506,117 * 3/1985 Fresard ..... 381/396
4,903,308 * 2/1990 Paddock et al. ..... 381/430

FOREIGN PATENT DOCUMENTS

WO 97/09842 3/1997 (WO) .
WO 98/31188 7/1998 (WO) .
WO 98/34320 8/1998 (WO) .

* cited by examiner

*Primary Examiner*—Sinh Tran
(74) *Attorney, Agent, or Firm*—Foley & Lardner

(57) ABSTRACT

A mid/high frequency loudspeaker drive unit comprising a stiff lightweight resonant panel form member, a housing to which the panel fog member is mounted, a resilient suspension connected between the edges of the panel form member and the housing, the arrangement being such that the housing and the panel for member together define a closed cavity, and an electrodynamic exciter for applying bending wave energy to the panel form member to cause it to resonate to produce an acoustic output, the exciter comprising a magnet assembly rigidly fixed to the housing and defining an annular gap, and a voice coil and coil former assembly disposed in the annular gap and rigidly fixed to the panel form member near to the geometric center thereof, wherein only the resilient suspension centers the voice coil and coil former assembly in the annular gap.

12 Claims, 3 Drawing Sheets

2
3
10
11
9
1
17
14
7
19
21
6
18
20
8
16
5
17
3

LOUDSPEAKERS

DESCRIPTION

This application is a continuation-in-part of Application Serial No. 08/707,012, filed Sep. 3, 1996. This application also claims the benefit of Provisional Application No. 60/150,804, filed Aug. 26, 1999, which is incorporated herein by reference.

TECHNICAL FIELD

The invention relates to loudspeakers, and more particularly to resonant panel loudspeakers, e.g., of the kind described in parent Application Serial No. 08/707,012 (incorporated herein by reference), i.e., so-called distributed mode loudspeakers.

BACKGROUND ART

In the past, there has been great difficult in providing a loudspeaker covering the mid and high frequency audio range at high quality. Directivity varies greatly in this range, and extension to the highest frequencies is very difficult for mid driver alone. Typically, two drivers are used with the expense and complication of a crossover network to divide the frequency range between them. The crossover frequency is generally around 3 kHz which is the most sensitive in human hearing which adds to the difficulty.

The concept of the present invention is to devise a mid and high frequency driver which replaces the two conventional drivers previously used, which does not crossover in the critical region and which has consistent, desirably wide directivity throughout its working range.

Distributed mode loudspeakers can be designed to operate over some 8-Octaves of the audio frequency band, although this may not always be the best solution, for instance in hi-fi applications. It is envisaged that it might sometimes be appropriate for a distributed mode loudspeaker to be used in association with a subwoofer for low frequencies, crossing over, say, at around 100 to 200 Hz.

There is therefore a need for a loudspeaker or at least a loudspeaker drive unit that is not meant to necessarily work over 8-Octaves but perhaps over 6 to 7 Octaves of the audio band, which would allow a wide choice of material and various construction possibilities that would help optimise the loudspeaker fully over its operating range. An example of this is a hi-fi midrange/tweeter drive unit working under the distributed mode loudspeaker principle. This can bring significant benefits to a conventional boxed loudspeaker system by allowing the cross-over point to be designed away form the critical 3 kHz area down to 1 khz range, typically 300–500 Hz as well as benefiting from the superior radiation properties associated with a distributed mode loudspeaker.

There is also an expanding market in multimedia and computer peripherals for high performance compact speakers and ever increasing demand for better sound and more compact construction for conventional televisions, monitors and flat panel televisions.

Thus there is a need for a structure that can be very compact and which can allow numerous features to be added for performance enhancement, application versatility and cost saving.

The present invention provides a cost-effective vehicle for all such applications and allows a manufacturer to optimize on tooling outlay and its production processes.

The basic concept revolves around a simple construction of the loudspeaker "engine" or drive unit which would allow easy production assembly and provide consistency.

DISCLOSURE OF INVENTION

According to the invention there is provided a mid/high frequency loudspeaker dive unit comprising a stiff light-weight resonant panel-form member, a housing to which the panel-form member is mounted, a resilient suspension connected between the edges of the panel-form member and the housing, the arrangement being such that the housing and the panel-form member together define a closed cavity and an electrodynamic vibration exciter for, applying bending wave energy to the panel-form member to cause it to resonate to produce an acoustic output, the exciter comprising a magnet assembly rigidly fixed to the housing and defining an annular gap, and a voice coil and coil former assembly disposed in the annular gap and rigidly fixed to the panel-form member near to the geometric center thereof, wherein only the resilient suspension.

The bending stiffness of the panel-form member may be in the range 0.15 Nm to 24 Nm and is preferably in the range 2 Nm to 9 Nm.

The vibration exciter may be borded to the panel-form member (herein after 'parel')and/or to the enclosure by way of injection moulding or by use of the adhesive. The vibration exciter voice coil may be bonded directly to a resonant panel during the injection moulding of the panel. Alternatively the voice coil of an exciter may be bodied into a pre-formed aperture moulded in a resonant panel during assembly. The need for a separate voice coil carrier is thus removed.

The panel may be co-moulded with the suspension. The suspension may be of resilient a material, eg plastics.

The panel may be injection moulded as a monolith or using foaming techniques. The panel may be flat or curved and may vary in thickness or cross-section.

The enclosure may have embedded electrically conducting inserts for carrying electrical signals efficiently from connectors on the enclosure edge to the vibration exciter. The assembly and connectivity of the drive unit may thus be automated.

The drive unit may be clad in other mouldings and structures to suet the application, efg. for aesthetic reasons. For example an appropriate trim will make it suitable for surface mounting onto a hi-fi speaker cabinet. Conversely, a suitable outer moulding will turn the engine into a multimedia speaker. Further the engine may be mounted onto other structures such as television cabinets.

BRIEF DESCRIPTION OF DRAWINGS

The invention is diagrammtically illustrated, by way of example in the accompanying drawings, in which.

BEST MODE FOR CARRYING OUT THE INVENTION

Figure 1:
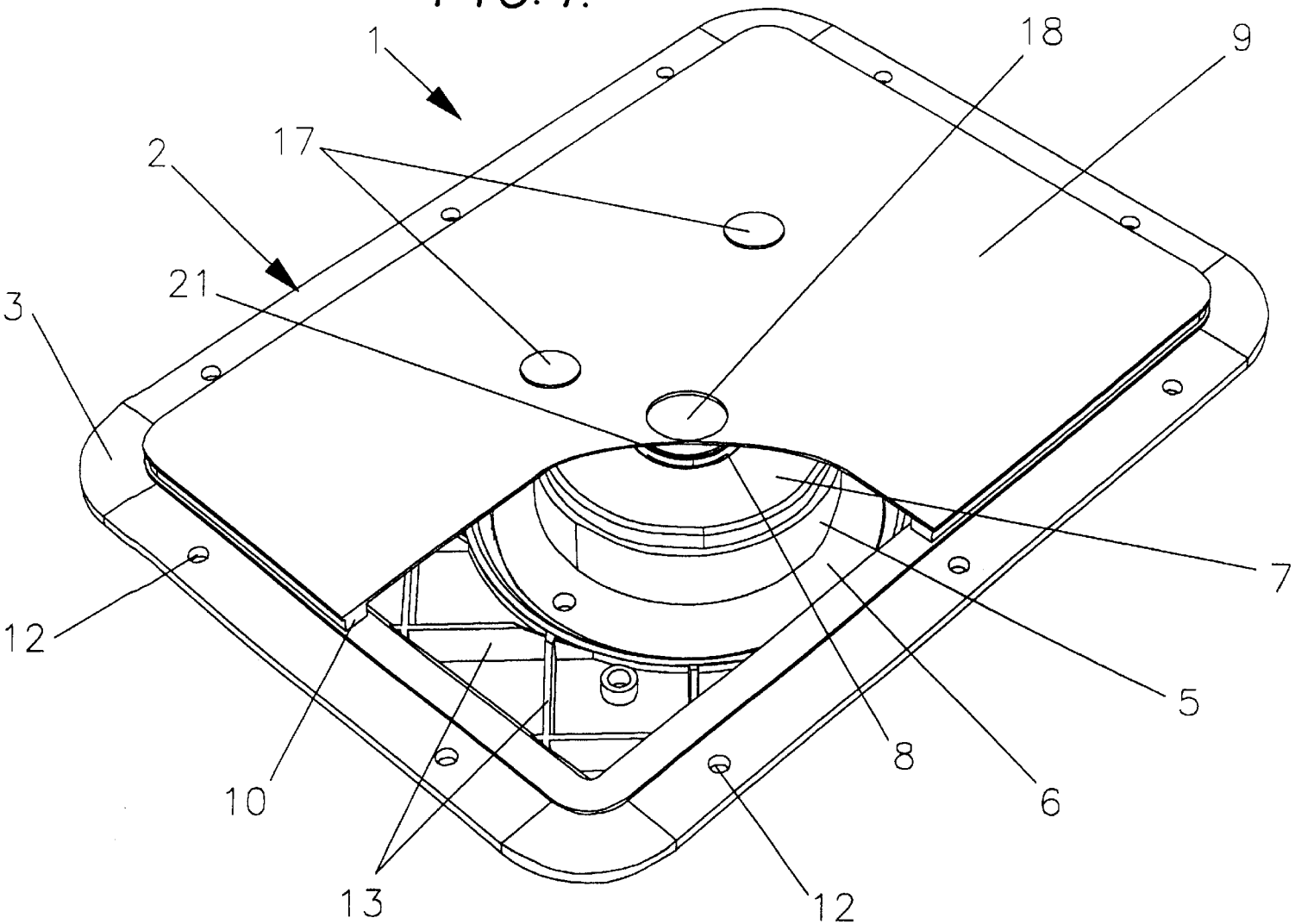
FIG. 1 is a perspective view, partly cut-away to reveal hidden detail, of a loudspeaker drive unit.
Figure 2:
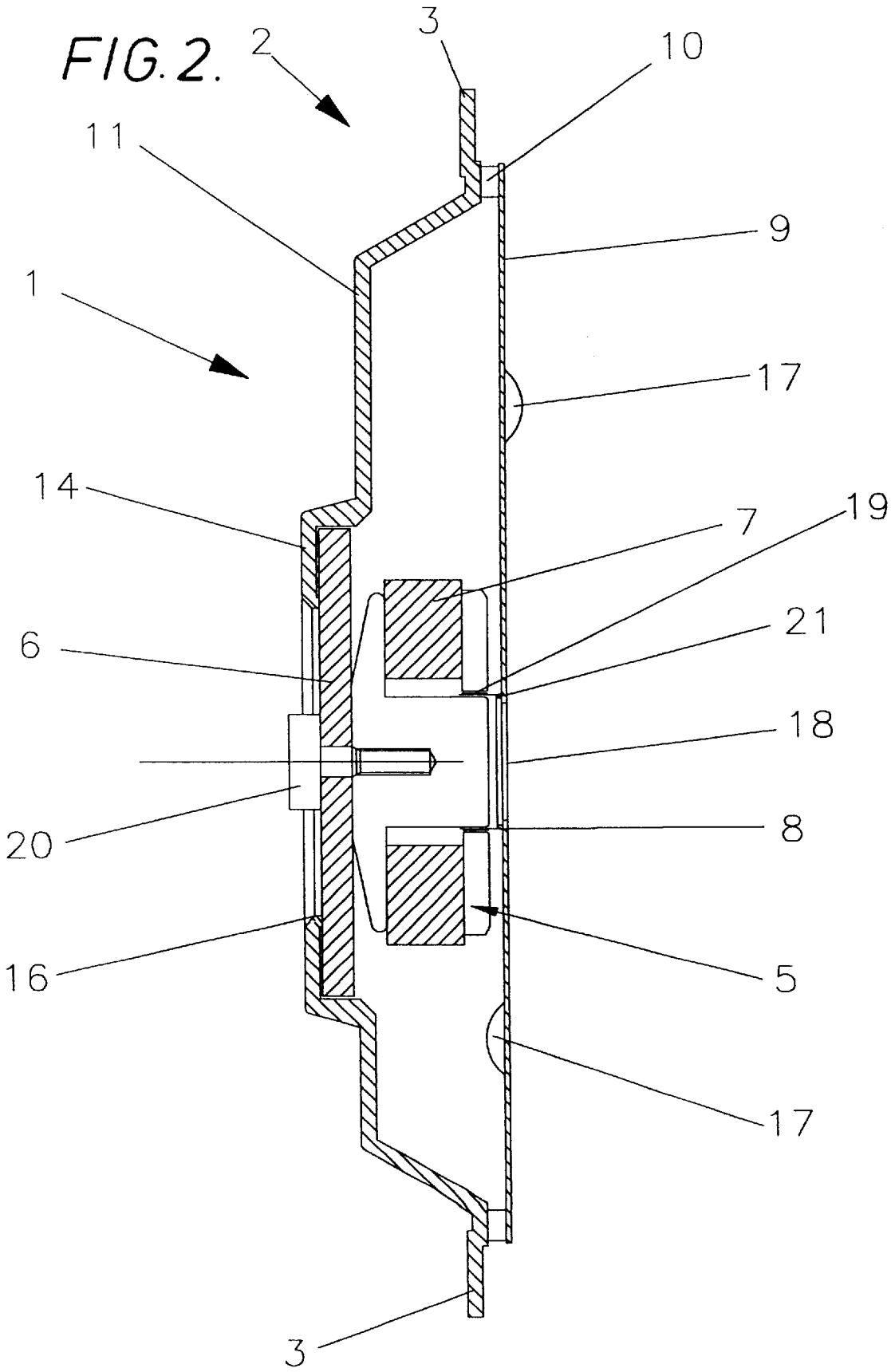
FIG. 2 is a cross-sectional side view of the loudspeaker drive unit of FIG. 1.

In the drawings there is shown a loudspeaker drive unit 1 intended as a mid/high frequency driver which may be used as a component in a loudspeaker system also comprising a low frequency driver, in which case the mid/high frequency and low frequency drivers may be assembled into a common cabinet, or as the sole driver in a compact loudspeaker, e. g. for multi-media or computer or automobile use.

The drive unit 1 comprises a generally rectangular housing 2 having a dish-like body 11 surrounded by an outwardly extending fixing flange 3 formed at intervals with holes 12 whereby the housing can be fixed in position by means of suitable fasteners (not shown) e.g. in the cabinet (not shown) of a loudspeaker. The housing, may be made from plastics, e.g. by injection moulding, and is formed internally with cross-bracing flanges 13 in the interests of adding stiffness to the housing while retaining its light-weight nature.

The housing 2 is formed at its base 14 with an internal generally circular shallow recess 4 having a central through hole 16, the recess being adapted snugly to receive a circular backing plate 6 on which is rigidly mounted the magnet assembly 7 of an electrodynamic vibration exciter 5 by means of a bolt 20. The exciter 5 comprises the said magnet assembly which defines an annular gap 19, and a voice coil and cylindrical former assembly 8 disposed in the annular gap and moveable axially thereof in response to an electrical signal applied to the voice coil.

The backing plate 6 is fixed to the housing in any convenient manner. Thus it may be fixed by fasteners or by adhesive means or may be moulded integrally with the housing.

Adjacent to the edge flange 3, a generally rectangular stiff, lightweight resonant panel-form member 9 is resiliently mounted on the housing 2 by means of a flexible foam suspension 10 which extends round the periphery of the panel 9. The housing and the panel thus define a closed cavity 15. The suspension 10 may be fixed to the panel 9 and to the housing 2 by adhesive means. The panel 9 is a distributed mode panel in accordance with the teaching in 08/707,012. The voice coil/former assembly 8 of the exciter 5 is rigidly fixed to the panel 9 at a suitable near-center drive position as taught in 08/707,012 to introduce bending wave energy into the panel to cause it to resonate to produce an acoustic output. The voice coil and coil former assembly 8 has an annular mounting member or foot 21, e.g. of plastics, rigidly fixed to its end adjacent to the panel 9 to aid its fixing to the panel, which may be with the aid of an adhesive. It is to be noted that, unusually, the exciter 5 is grounded to the housing 2 and does not comprise a suspension between the magnet assembly and the voice coil so that centring of the voice coil in the annular: gap 19 of the magnet assembly is achieved only by the panel edge suspension 10. In this way the moving mass of the exciter is reduced to improve its high frequency response. The magnet assembly may be thermally coupled to the voice coil to improve its power capacity and heat may be radiated from the exposed rear face of the backing plate 6.

Selective locally positioned small masses 17, e.g. in the range from about 2 to12 grams are bonded to the panel to optimally tune the coupled resonances such that the overall response is suitably tailored. This technique has the specific advantage of extending the low frequency range of the assembly. An aperture 18 through the panel 9 coaxial with the voice coil extends the high frequency response. Some acoustic absorbent material (not shown) in the cavity 15 may be helpful in reducing the magnitude of higher order standing waves in the cavity, and may further refine the frequency response.

A drive unit as described above may have the following specification:

Panel size=210×148.5 mm (A5 std. size)

Core=3 mm polycarbonate honeycomb, 3.5 mm cell diameter

Skins=100 $\mu$m woven glass reinforced polycarbonate faceskins (0°/90° skin orientation) 50 wt % glass Bending stiffness=5.6 Nm Areal density, $\mu$0.7 kg/m$^2$ Zm=16 Ns/m Voice coil diameter=26 mm Coil is positioned at standard distributed mode position (4/9, 3/7=ratio)

Large ferrite ring magnet to improve BL and power handling.

Figure 3:
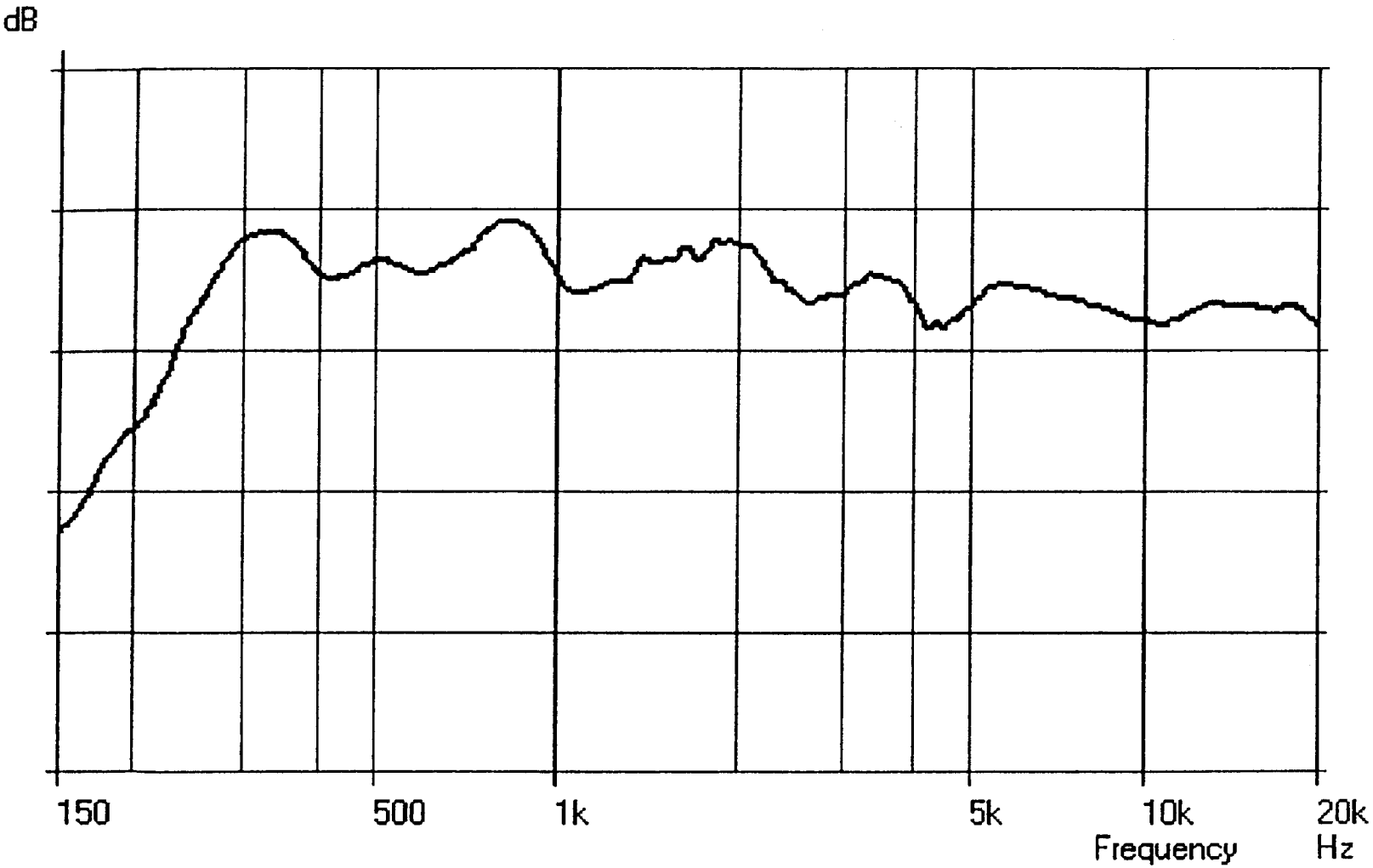
FIG. 3 is a graph representing the frequency response of the drive unit of FIGS. 1 and 2.

As discussed, there is no suspension between v he magnet and the voice coil and the panel is held in position by the foam suspension around the edge. The panel may be aligned and located accurately using the hole in the panel within the voice coil to assist alignment of the voice coil in the annular gap. Locating pins might possibly be provided on the housing near to the panel edges to prevent sideways movement of the panel. The frequency response of this panel is shown in FIG. 3.

Smaller versions of the drive unit are envisioned with high quality piezo exciters which may extend the response into the ultrasonic range which could be useful in connection with new audio formats with a 50 kHz or 100 kHz sound bandwidth; this performance is beyond the compass of conventional pistonic technology.

INDUSTRIAL APPLICABILITY

The invention thus provides a novel loudspeaker drive unit for mid and high frequencies which solves significant problems in known arrangements both as concerns frequency cross-over problems and dispersion.

What is claimed is:

1. A mid/high frequency loudspeaker drive unit comprising a stiff lightweight resonant panel form member, a housing to which the panel form member is mounted, a resilient suspension connected between the edges of the panel form member and the housing, the arrangement being such that the housing and the panel form member together define a closed cavity, and an electrodynamic exciter for applying bending wave energy to the panel form member to cause it to resonate to produce an acoustic output, the exciter comprising a magnet assembly rigidly fixed to the housing and defining an annular gap, and a voice coil and coil former assembly disposed in the annular gap and rigidly fixed to the panel form member near to the geometric center thereof, wherein only said resilient suspension centers the voice coil and coil former assembly in the annular gap.

2. A loudspeaker drive unit according to claim 1, wherein the housing comprises a dished body surrounded by a fixing flange.

3. A loudspeaker drive unit according to claim 2, wherein the dished body comprises a through aperture and wherein the magnet assembly of the exciter is rigidly mounted on the dished body whereby a part of its surface closes the through aperture in the body.

4. A loudspeaker drive unit according to claim 3, comprising a recess in the dished body, and wherein the magnet assembly comprises a back plate mounted in the recess in the dished body, the recess being formed with the through aperture.

5. A loudspeaker according to claim 1, wherein the resilient suspension is of foam material.

6. A loudspeaker drive unit according to claim 1, wherein the panel-form member comprises a core of honeycomb material sandwiched between skin layers and has a bending stiffness in the range of from about 0.15 Nm to about 24 Nm.

7. A loudspeaker drive unit according to claim 6, wherein the bending stiffness is in the range of from about 2 Nm to about 9 Nm.

8. A loudspeaker drive unit according to claim 3, comprising an aperture through the panel-form member and coaxial with and smaller than the diameter of the voice coil.

9. A loudspeaker drive unit according to claim 8, comprising at least one discrete mass mounted on the panel-form member and positioned to damp the low frequency response thereof.

10. A loudspeaker drive unit according to claim 1, comprising an aperture through the panel-form member and coaxial with and smaller than the diameter of the voice coil.

11. A loudspeaker drive unit according to claim 10, comprising at least one discrete mass mounted on the panel-form member and positioned to damp the low frequency response thereof.

12. A loudspeaker drive unit according to claim 1, comprising at least one discrete mass mounted on the panel-form member and positioned to damp the low frequency response thereof.

* * * * *